US008065993B2

(12) United States Patent
Festag et al.

(10) Patent No.: US 8,065,993 B2
(45) Date of Patent: Nov. 29, 2011

(54) STRUCTURAL OIL BAFFLE FOR ENGINE COVERS

(75) Inventors: Georg Festag, Dearborn, MI (US); Philip Damian Cierpial, Grosse Pointe Park, MI (US); Abdelhakim Baghdadi, Ypsilanti, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 403 days.

(21) Appl. No.: 12/336,343

(22) Filed: Dec. 16, 2008

(65) Prior Publication Data

US 2010/0147235 A1 Jun. 17, 2010

(51) Int. Cl.
*F02M 25/00* (2006.01)

(52) U.S. Cl. ..... 123/572; 123/90.27

(58) Field of Classification Search ..... 123/572–573, 123/41.86, 90.27, 195 C
See application file for complete search history.

(56) References Cited

U.S. PATENT DOCUMENTS

| | | | | |
|---|---|---|---|---|
| 4,323,745 | A | 4/1982 | Berggren | |
| 4,593,659 | A | 6/1986 | Wells et al. | |
| 4,683,850 | A | 8/1987 | Bauder | |
| 5,005,553 | A * | 4/1991 | Washizu et al. | 123/572 |
| 5,129,371 | A * | 7/1992 | Rosalik, Jr. | 123/90.38 |
| 5,323,740 | A | 6/1994 | Daily et al. | |
| 5,323,745 | A | 6/1994 | Sato et al. | |
| 5,492,086 | A | 2/1996 | Kuhns | |
| 5,636,759 | A | 6/1997 | Brummer | |
| 6,453,892 | B1 * | 9/2002 | Plunkett et al. | 123/572 |
| 2008/0223348 | A1 * | 9/2008 | Togasawa | 123/572 |
| 2010/0147273 | A1 * | 6/2010 | Akiyama et al. | 123/572 |

* cited by examiner

*Primary Examiner* — M. McMahon
(74) *Attorney, Agent, or Firm* — Julia Voutyras; Alleman Hall McCoy Russell & Tuttle LLP

(57) ABSTRACT

An oil baffle, a system, and a method are disclosed for separating a gaseous component from oil in a blow-by vapor for an internal combustion engine. An example system may include a cam cover configured to be mounted on a cylinder head. The system may also include an oil baffle including a first face coupled to the cam cover and may define an oil separation chamber between the cam cover and the first face. The oil baffle may include one or more stiffening members coupled to and extending from and substantially normal to an opposite face in order to reduce noise.

10 Claims, 5 Drawing Sheets

STRUCTURAL OIL BAFFLE FOR ENGINE COVERS

FIELD

The present application relates to an oil baffle provided in an internal combustion engine to separate oil from blow-by gases having improved vibration isolation, and noise abatement characteristics.

BACKGROUND AND SUMMARY

When an air-fuel mixture is combusted in an engine combustion chamber, a small portion of the combusted gas may enter the engine crankcase through the piston rings. This gas is referred to as blow-by gas. To prevent this untreated gas from being directly vented into the atmosphere, a crankcase ventilation system is provided between the higher pressure crankcase and the lower pressure intake manifold to allow the blow-by gas to flow from the crankcase into the intake manifold and be mixed with fresh air. From here, the gas may be re-inducted into the combustion chamber for re-combustion.

Engine lubrication oil used to lubricate moving parts of the engine is present in the crankcase during normal engine operation. The high pressure in the crankcase causes some of the lubricating oil to be suspended in a mist form. This oil mist can then mix with the blow-by gas and be returned to the intake manifold for combustion via a communication passage. However, combustion of the oil may cause the net oil consumption to increase, as well as degrade engine emission quality. To address these issues, oil separators have been developed to separate the oil content from the blow-by gas containing the oil mist. After separation, the oil is returned to the engine lubricating system while the blow-by gas is returned to the engine intake system. An oil separator may be formed within a cam cover by positioning an oil baffle within the cam cover and form an oil separation chamber therein. The blow-by gas containing the oil mist, i.e. blow-by vapors, may be passed though the oil separation chamber.

However, one potential problem with cam covers and oil baffles is that they may be contributors to the overall noise radiated by an internal combustion engine during operation. Also it is becoming more common to include composite materials, including composites that include plastics, in internal combustion engines. However, this increases the challenge of reducing engine noise because benchmarking and experience indicate that isolated cam covers made of composite materials may be noisier than isolated cam covers made of metallic materials.

One approach to create a plastic rocker cover defining an oil-gas separating chamber is disclosed by Sato et al. in U.S. Pat. No. 4,323,745. Sato et al. disclose a rocker cover with an outer cover, and an inner partition member disposed inside the outer cover forming a gas separation chamber. Downward and upward barrier-like projections are arranged in line and in intervals in the direction of flow of the blow-by gases. The projections form a zig-zag shaped blow-by gas passage for promoting separation of oil from blow-by gases. The outer cover member has a buffer wall in the form of a rectangular ring or tube disposed inside of the peripheral wall thereof. The partition member is secured to a lower free end of the buffer wall. However, the inventors have recognized several issues with such an oil separator. As one example, the inner partition member may lack sufficient rigidity to avoid significant vibration, and the way the outer cover member and the inner partition member are secured to one another may also contribute to excess vibration between the outer cover member and the inner partition member.

Thus in one example, the above issues may be addressed by a system for an internal combustion engine. The system may include a cam cover configured to be mounted on a cylinder head. The system may also include an oil baffle that may have a generally planar body with a first face and a second face opposite the first face. The first face may be coupled to the cam cover and may define an oil separation chamber between the cam cover and the first face. The oil baffle may include one or more stiffening members coupled to and extending from and substantially normal to the second face.

In this way various example valve covers in accordance with the present disclosure may have a high structural rigidity. In addition, various example valve covers in accordance with the present disclosure may include an attachment pattern connecting the cam cover to the oil baffle that may add to its effectiveness in reducing cover surface vibration and cover radiated noise.

In this way, the amount of noise and vibration that may be radiated by the valve cover may be greatly reduced. In addition, manufacturing costs may be reduced by molding the whole baffle arrangement using a single mold. And, in another example in which the separator is configured to enable oil separated at the baffles to drip directly onto the camshaft or onto cam caps, the need for oil drain valves and/or oil drain paths may be averted or reduced, thereby allowing the separator to work more efficiently within the spatial constraints.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
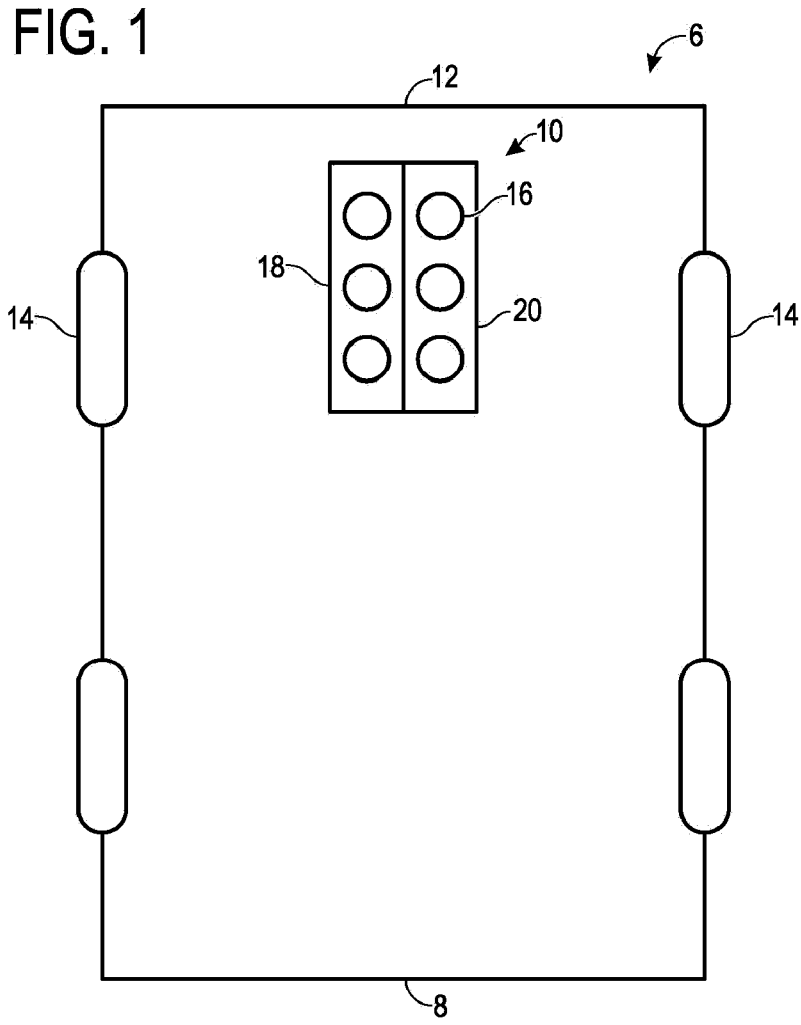
FIG. 1 shows an example engine layout within a vehicle system.

The following description relates to a system 6 for separating oil from blow-by gas in an engine 10 of a vehicle 8 as shown in FIG. 1. The system 6 may be mounted inside the engine 10, within a cam cover, and/or on top of a cylinder head. The system 6 of the present disclosure may include an oil baffle that may have sufficient rigidity and that may be coupled to the cam cover at locations and/or in a pattern that may make the system particularly effective in reducing the amount of vibration and noise from the engine.

The separated oil may be returned to the crankcase for lubricating a crankshaft, and/or sent to the camshaft assembly for lubricating the rotating cam lobes, camshaft and/or the valve assembly. Various parameters of the oil separator may be tuned to different engines based on the desired oil challenge, oil particle size, and an oil consumption target. Thus, an oil separator of the disclosed configuration may enable efficient oil separation and improved NVH isolation characteristics.

FIG. 1 shows a vehicle system 6 including vehicle 8. Engine 10 is provided in an engine compartment of vehicle 8. In the depicted example, vehicle 8 is an automobile. In alternate examples, engine 10 may be included as a portion of a hybrid propulsion system including one or more other motors or engines, such as in the case of a hybrid electric vehicle (HEV). While the example applications of engine 10 will be described with reference to vehicle 8, it should be appreciated that engine 10 may be used in other applications not necessarily confined to vehicle propulsion systems.

Figure 2:
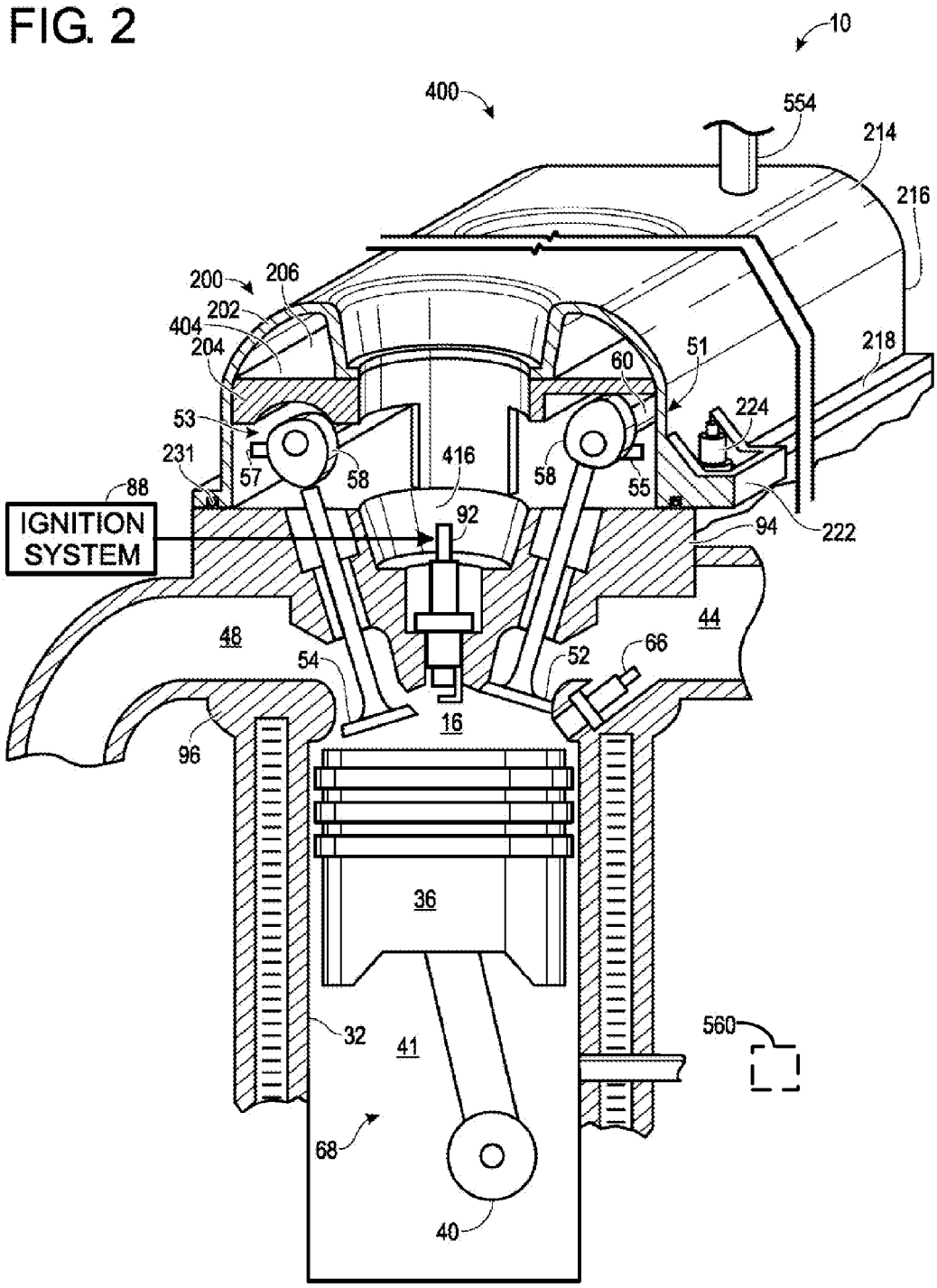
FIG. 2 is combination cross-sectional and isometric depiction of one cylinder in an internal combustion engine configured to propel a vehicle, with an oil separator configured in accordance with the present disclosure.

Engine 10 may be located towards the front 12 of vehicle 8, generally forward of the front wheels 14 and behind a radiator (not shown). Other locations are possible, such as toward the rear of the vehicle. Engine 10 may include a plurality of cylinders 16. As depicted, engine 10 is a 6-cylinder, V-shaped, four-stroke engine, although it will be appreciated that the engine may have a different cylinder configuration (for e.g., in-line, or opposed) and/or a different number of cylinders (e.g., four, or eight). The plurality of cylinders 16 may be aligned to clearly distinguish a left-hand side 18 of the engine from a right-hand side 20. The oil separator of the present disclosure may be mounted on a cylinder head of the engine block (as illustrated in FIG. 2) on, for example, the left-hand side 18. However, a similar (or symmetric) oil separator may also be used on the right-hand side 20 of the engine.

FIGS. 2-6 illustrate additional details of an oil separator located in engine 10 for separating oil from blow-by gas, before the gas is returned to an intake manifold of engine 10. First, the general layout of the oil separator with respect to the cylinders 16 of engine 10 is described with reference to FIG. 2.

FIG. 2 shows a combination cross-sectional and isometric diagram of one cylinder 16 of multi-cylinder engine 10. Engine 10 may be controlled at least partially by a control system that may include a controller (not shown), and by input from a vehicle operator via an input device such as an accelerator pedal. Combustion chamber (i.e. cylinder) 16 of engine 10 may include combustion chamber walls 32 with piston 36 positioned therein. Piston 36 may be coupled to crankshaft 40 so that reciprocating motion of the piston 36 may be translated into rotational motion of the crankshaft 40. Crankshaft 40 may be housed in a crankcase 41. The crankcase 41 may hold oil. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 16 may receive intake air from an intake manifold 44, and may exhaust combustion gases via exhaust passage 48. Intake manifold 44 and exhaust passage 48 may selectively communicate with combustion chamber 16 via respective intake valve 52 and exhaust valve 54. In some embodiments, combustion chamber 16 may include two or more intake valves and/or two or more exhaust valves.

In this example, intake valve 52 and exhaust valve 54 may be controlled by cam actuation via respective cam actuation systems 51 and 53. Cam actuation systems 51 and 53 may each include one or more cams 58 and may utilize one or more of cam profile switching (CPS), variable cam timing (VCT), variable valve timing (VVT) and/or variable valve lift (VVL) systems that may be operated by the controller to vary valve operation. The cams 58 may be configured to rotate on respective revolving camshafts 60. As depicted, the camshafts may be in a double overhead camshaft (DOHC) configuration, although alternate configurations may also be possible. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 16 may include an intake valve controlled via electric valve actuation and an exhaust valve controlled via cam actuation including CPS and/or VCT systems.

In one embodiment, twin independent VCT may be used on each bank of a V-engine. For example, in one bank of the V, the cylinder may have an independently adjustable intake cam and exhaust cam, where the cam timing of each of the intake and exhaust cams may be independently adjusted relative to crankshaft timing.

Fuel injector 66 is shown coupled directly to combustion chamber 16 for injecting fuel directly therein in proportion to a pulse width of a signal that may be received from the controller. In this manner, fuel injector 66 provides what is known as direct injection of fuel into combustion chamber 16. The fuel injector 66 may be mounted in the side of the combustion chamber or in the top of the combustion chamber, for example. Fuel may be delivered to fuel injector 66 by a fuel system (not shown) including a fuel tank, a fuel pump, and a fuel rail. In some embodiments, combustion chamber 16 may alternatively or additionally include a fuel injector arranged in intake passage 44 in a configuration that provides what is known as port injection of fuel into the intake port upstream of combustion chamber 16.

Ignition system 88 may provide an ignition spark to combustion chamber 16 via spark plug 92 in response to a spark advance signal from the controller, under select operating modes. Though spark ignition components are shown, in some embodiments, combustion chamber 16 or one or more other combustion chambers of engine 10 may be operated in a compression ignition mode, with or without an ignition spark.

Cylinder head 94 may be coupled to a cylinder block 96. The cylinder head 94 may be configured to operatively house, and/or support, the intake valve(s) 52, the exhaust valve(s) 54, the associated valve actuation systems 51 and 53, and the like. Cylinder head 94 may also support camshafts 60. Other components, such as spark plug 92 may also be housed and/or supported by the cylinder head 94. The cylinder block 96 may be configured to house the piston 36. In one example, cylinder head 94 may correspond to a cylinder located at a first end of the engine. While FIG. 2 shows only one cylinder 16 of a multi-cylinder engine, each cylinder may similarly include its own set of intake/exhaust valves, fuel injector, spark plug, etc.

FIG. 2 also shows an oil separator 200 mounted on and supported by cylinder head 94. The oil separator 200 may extend lengthwise along a portion of the length of the engine bank, that is, in a direction parallel to the axes of the camshafts 60. Oil separator 200 may comprise a cam cover 202 and a baffle 204. Cam cover 202 may be mounted on cylinder head 94, substantially covering cylinder head 94, and fully enclosing the components of the baffle 204 and the camshaft assembly. In some other examples, baffle 204 may be configured to directly sit on cylinder head 94. Together, the cam cover 202 and baffle 204 may define a space above the cylinder head 94 wherein oil separation may occur, hereafter referred to as oil separation chamber 206.

Figure 3:
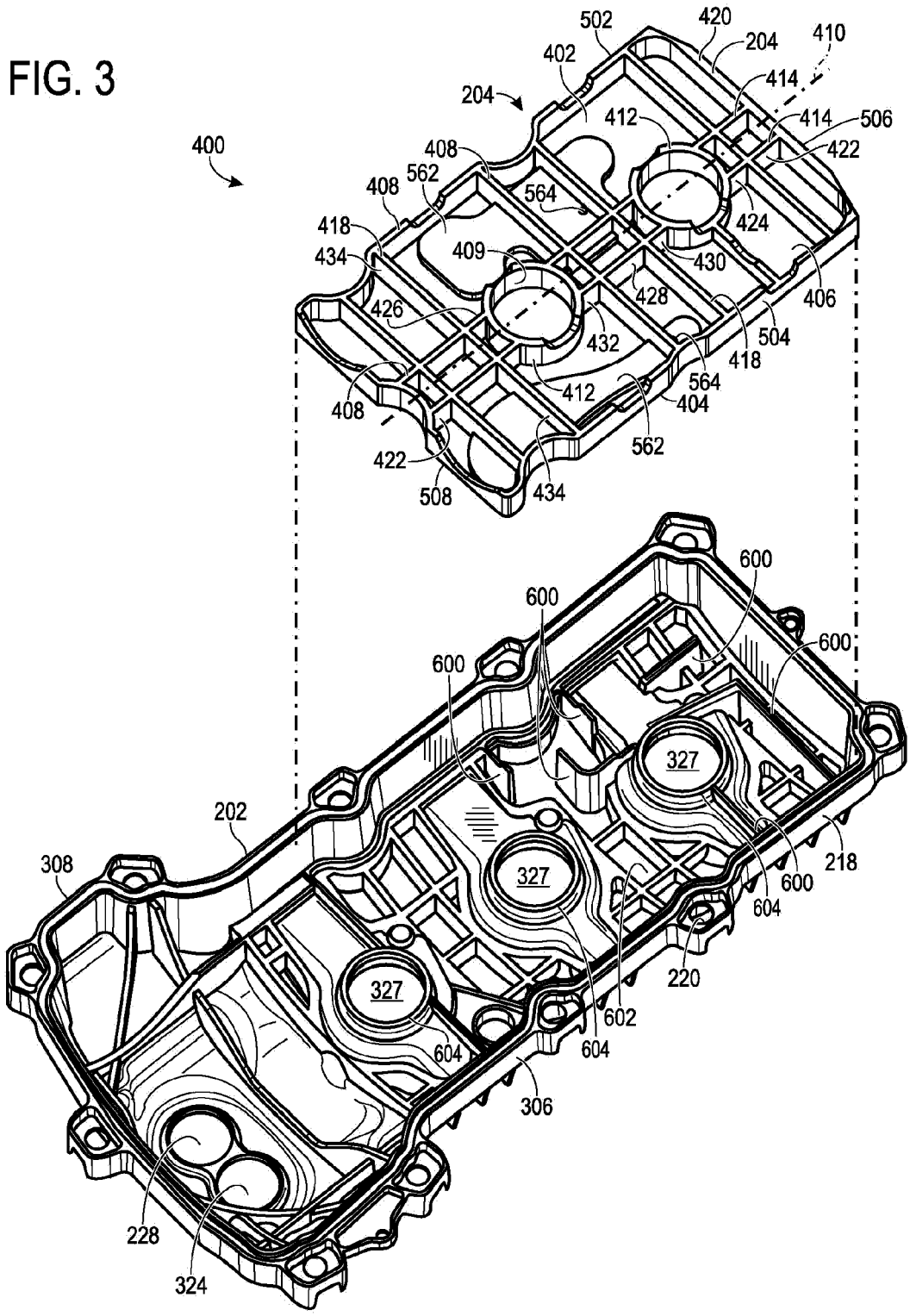
FIG. 3 is an exploded bottom view of the components and configuration of the oil separator including an upper cam cover and a lower baffle plate assembly.

Continuing with reference to FIG. 2 and also now with reference to FIG. 3. FIG. 3 is an exploded bottom view of the oil baffle 204 and the cam cover 202, illustrating how the baffle 204 may be positioned in the cam cover 202. Cam cover 202 may include a main body 214 which may be generally dome shaped, and may be configured to substantially provide a covering surface. Cam cover 202 may also include a peripheral section 216. The peripheral section 216 may extend into a perimeter flange 218 that is juxtaposed on cylinder head 94. The cam cover 202 may be mounted and sealed on cylinder head 94 with a plurality of bolts threaded through a plurality of bolt insertion holes 220 (FIG. 3) interspersed along the perimeter flange 218 of cam cover 202 at fastening lugs 222. Each insertion hole 220 may align with a corresponding hole in the top of cylinder head 94. A stud and grommet assembly 224 may be used in the holes to affix oil separator 200 to cylinder head 94. To additionally seal the cam cover 202 onto cylinder head 94, an elastomeric perimeter gasket 231 may be provided on the lower surface of the cam cover 202. Specifically, the perimeter gasket 231 may be located on the lower surface of the cam cover 202, near the junction where the peripheral section 216 starts extending into the perimeter flange 218.

The main body 214 of cam cover 202 may further include a plurality of holes. The plurality of holes may be dispersed between a narrow section 306 and a wide sections 308 of the cam cover main body 214. As one example, a plurality of spark plug holes 327 may be formed in the narrow section 306. In the depicted example, the cam cover has 3 spark plug holes, although in alternate embodiments, it may have a different number, such as 4 or 6. The spark plug holes 327 may be located at positions which respectively correspond to the center of underlying cylinder bores. The spark plug holes 327 may be numbered based on the corresponding cylinder number. Alternatively, the spark plugs holes 327 may be numbered based on their distance from the narrow end 302 of the cam cover, as depicted. Thus, the spark plug hole closest to the narrow end may herein be labeled spark plug hole #1, and so on. Spark plugs may be fixedly disposed in the respective spark plug holes.

The wide section 308 of cam cover 202 may also be configured with a plurality of holes. In the depicted embodiment, the wide section 308 may comprise primarily two holes corresponding to an oil fill hole 228 and a VCT hole 324. The VCT hole 324 may be positioned above a bolt-affixed VCT solenoid (not shown). Electrical connections (such as a VCT coupling) to the VCT solenoid may be fixedly disposed in the VCT hole 324 and sealed with an appropriate sealing element, such as a VCT gasket (not shown).

PCV pipe connection 554 may be configured to enable the blow by gas after at least some oil has been separated from it in the oil separation chamber 206 to be transferred into the engine intake manifold 44. In the case of turbocharged engines, this PCV pipe connection 230 may connect to a compressor inlet tube of the turbocharger, which in turn may transfer blow-by gas and air to the intake manifold.

A system 400 for the internal combustion engine for separating oil from a blow-by vapor is provided. The system 400 may include the cam cover 202 configured to be mounted on the cylinder head 94. The system 400 may also include the oil baffle 204 that may have a generally planar body 402 with a first side, or a first face 404 and a second side, or second face 406 opposite the first face 404. The first face 404 may be coupled to the cam cover 202 and may be configured to form, or to define, the oil separation chamber 206 between the cam cover 202 and the first face 404. The first face 404 may be configured to be attached to the cam cover 202. The oil baffle planar body first face 404 may be configured to be exposed to an oil and gas mixture, and may be configured to allow at least some of the oil from the oil and gas mixture to at least temporarily attach to one or more surfaces within the oil separation chamber 206 and to separate from the oil and gas mixture. The oil baffle 204 may include one or more stiffening members 408 that may be coupled to and may extend from the second face 406. The one or more stiffening members 408 may be disposed substantially normal to the second face 406.

In some examples at least two holes 409 may pass through the planar body 402. The holes 409 may be arranged substantially along a longitudinal axis 410 of the oil baffle 204. The longitudinal axis 410 may be a central axis. The stiffening members 408 may extend from the second face 406 and may include at least two substantially cylindrical elements 412 extending from the second face 406. The at least two substantially cylindrical elements 412 may be disposed annularly around each of the at least two holes 409. Two spaced apart longitudinal ribs 414 may be arranged on either side of and substantially parallel to the longitudinal axis 410. Each of the longitudinal ribs 414 may be fixed to one of the cylindrical elements 412. The substantially cylindrical elements 412 may extend from the second face 406, and each may be configured to be disposed around a sparkplug access area 416. In some examples the one or more stiffening members 408 may form a matrix of interconnected longitudinal ribs 414, transverse ribs 418, and the cylindrical elements 412.

In some examples the longitudinal ribs 414, the transverse ribs 418, and cylindrical elements 412, and the planar body 402 may be integrally formed as a single element. They may be for example, made as an integral part using, for example, a molding operation. The oil baffle 204 may be made from a composite material. The composite material may include a plastic. In some examples the oil baffle 204 may be made from a substantially homogenous material that may be, for example, plastic. In some examples the oil baffle 204 may be made from a metal. In some examples the one or more stiffening members 408 may include a perimeter wall 420. The perimeter wall 420 may also be made integrally with one or more parts of the oil baffle 204.

Each of the longitudinal ribs 414 may be connected on a first end 422 to the perimeter wall 420, and each may be connected on a second end 424 to one of the cylindrical elements 412. The two longitudinal ribs 414 may be discontinuous ribs connected on the opposites ends 422 to the perimeter wall 420, as stated, and may be connected at intermediate locations 426 to the at least two substantially cylindrical elements 412. The longitudinal ribs 414 may be made discontinuous at the least two holes 409. Each of the longitudinal ribs 414 may then have a middle portion 428 that may be connected on a first end 430 to one of the cylindrical elements 412, and connected on a second end 432 to another of the one of the cylindrical elements 412.

The transverse ribs 418 may be two or more transverse ribs 418. Each transverse rib 418 may be connected to the perimeter wall 420 at opposite ends 434 thereof, and each may cross and be connected to the longitudinal ribs 414.

Figure 4:
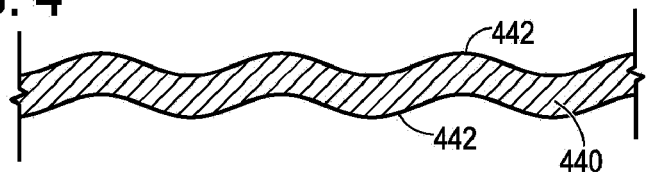
FIG. 4 and FIG. 5 are cross sections showing possible example profiles of various parts of the oil baffle.
Figure 5:
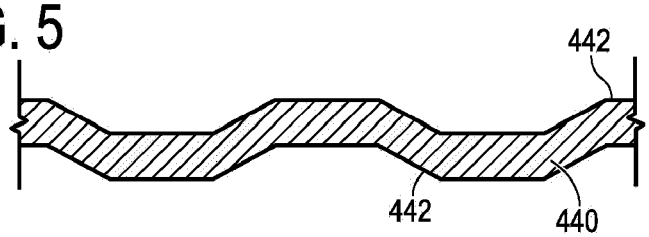

FIGS. 4 and 5 are cross-sectional views illustrating possible cross-sectional profiles of various parts of the oil baffle 204. The cross-sectional line may be taken at various locations on the oil baffle and is therefore not illustrated as being taken at any particular location in FIG. 3. The figures illustrate examples wherein one or more of the longitudinal ribs 414, the transverse ribs 418, the cylindrical elements 412, and the planar body 402 may have corrugated profiles 440 and/or surfaces. FIG. 4 illustrates a substantially wavy corrugated profile 440. FIG. 5 illustrates a substantially trapezoidally corrugated profile 440. Other contoured profiles may be used. In some examples, various parts of the oil baffle 204 may have respectively different profiles. In this way the oil baffle 204 may have added strength and rigidity. One, or more, or all, of the various parts of the oil baffle 204 may also have non-contoured profiles. FIG. 3 illustrates such an example.

Figure 6:
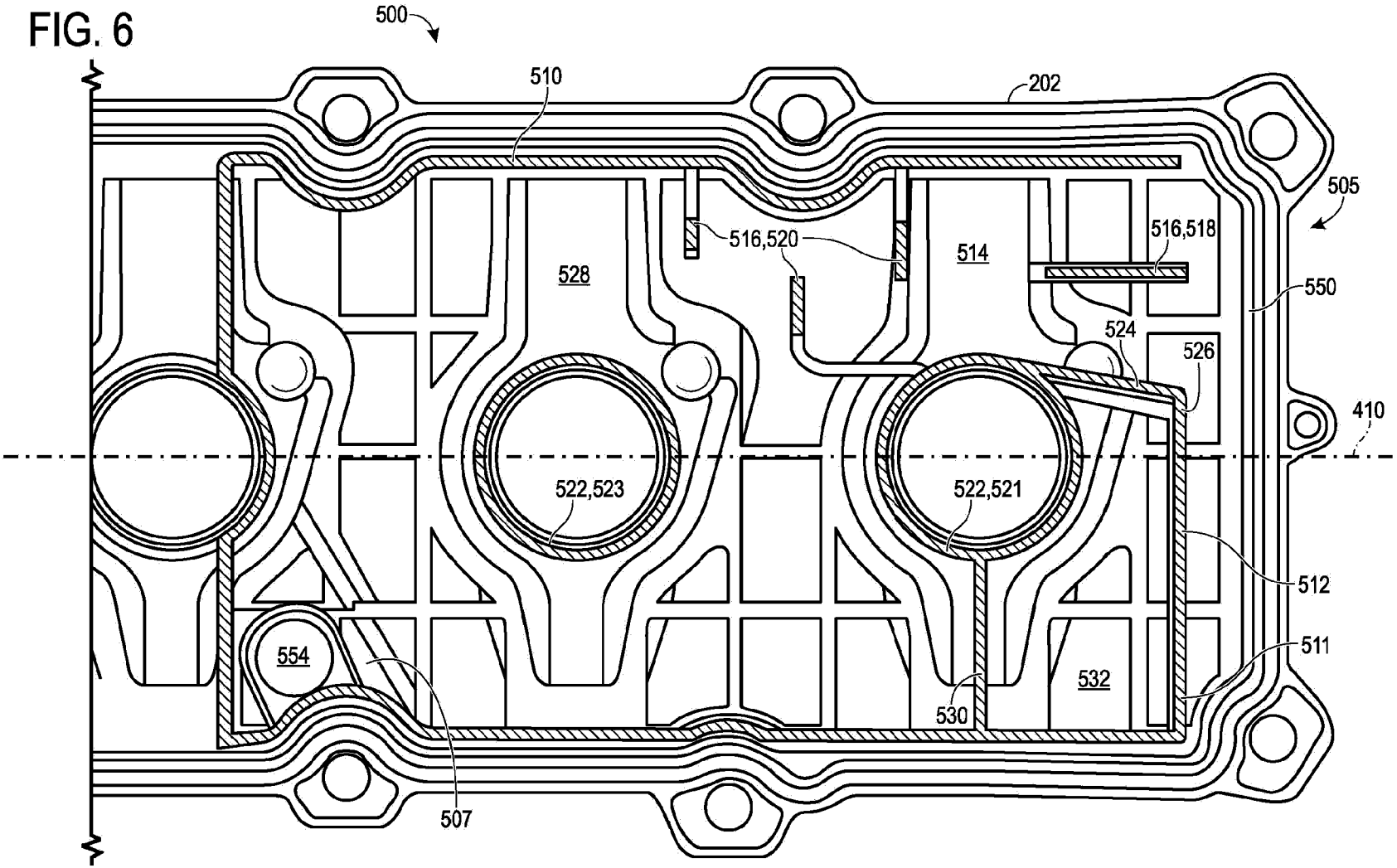
FIG. 6 is a bottom view of the cam cover showing an attachment pattern illustrating where the baffle may be attached to the cam cover.

FIG. 6 is a bottom view illustrating a location where the oil baffle 204 may be installed within the cam cover 202. An attachment pattern 500, shown here in cross hatching, illustrates where the oil baffle 204 may be attached to the cam cover 202. Referring now to FIG. 6 and also to FIG. 3, the oil baffle 204 first face 404 may be generally rectangular and may have a first longitudinal edge 502 and second longitudinal edge 504. The longitudinal edges 502 and 504 may be spaced apart from one another. The oil baffle 204 may also have a first transverse edge 506, and a second transverse edge 508 spaced apart from the first transverse edges 506. The first transverse edge 506 may be at an inlet end 505 and the second transverse edge 508 may be at an outlet end 507 of the oil separation chamber 206.

The oil separation chamber 206 may include an inlet 550 at the inlet end 505 of the oil separation chamber 206. The inlet 550 may be, for example, a space between the oil baffle 204 and the cam cover 202. Other configurations may be used. The inlet 550 may be configured to receive an oil and gas mixture, for example a blow-by vapor from the crankcase 41. The oil separation chamber 206 may also include an outlet 554 coupled to the intake passage 44 of the internal combustion engine 10, and configured to pass a gas component of the blow-by vapor to the intake passage 44. The oil and gas mixture may be from the crankcase 41 of the internal combustion engine 10 and may be introduced to the oil separation chamber 206 via a Positive Crankcase Ventilation (PCV) valve 560 (FIG. 2).

Oil mist may be separated by passage of the blow-by gas through the oil separation chamber 206, and upon the suspended oil droplets impacting against various surfaces in the oil separation chamber 206. Oil droplets may strike and adhere to the various surfaces and gradually grow into larger oil droplets that may drop to the first face 404 of the oil baffle 204 due to their own weight. The separated oil droplets may then collect in the oil separation chamber 206. The oil separation chamber 206 may include one or more pockets 562, the bottoms of which are visible in FIG. 3 where the oil droplets may collect further and/or be directed to a through hole 564 located in each pocket 562. The oil may drop to the rotating cams and camshafts where it may be used, or to the crankcase, or to other parts of the engine 10.

The dimensions and/or proportions of the various elements disclosed herein may be tuned to different engines based on the desired oil challenge, oil particle size, and an oil consumption target. Thus, an oil separator of the disclosed configuration may enable efficient oil separation notwithstanding engine spatial constraints.

Referring again, and in particular, to FIG. 6, the attachment pattern 500 may include a substantially continuous first attachment 510 arranged at, or adjacent to, the first longitudinal edge 502 the second transverse edge 508 and the second longitudinal edge 504 of the oil baffle 204 and/or the cam cover 202. A second attachment 512 may be disposed substantially parallel to the first transverse edge 506, and may be shorter than the first transverse edge 506 to provide a passage 514 between the first attachment 510 and the second attachment 512. Two or more interior attachments 516 may be arranged in and/or adjacent to the passage 514 to provide a tortuous path for the blow-by vapor as the blow-by vapor passes from the inlet end 505 to the outlet end 507.

The second attachment 512 may be connected to the first attachment 510 at a first end 511 of the second attachment 512 along, or adjacent to, the second longitudinal edge 504. The two or more interior attachments 516 may include a first interior attachment 518 disposed substantially parallel with a longitudinal axis of the oil baffle 204 and two or more baffling attachments 520 disposed substantially transverse to the longitudinal axis 410 and mutually offset from one another. Mutually offset from one another may be considered to be having one or both ends being at different distance from, for example the first longitudinal edge 502.

The oil baffle 204 may also, or instead, be attached to the cam cover 202 with one or more annular attachments 522 on a respective annular edge of the one or more holes 409 on the first face 404. A directing attachment 524 may extend from a second end 526 of the second attachment 512 to one of the one or more annular attachments 522. The one of the annular attachments 522 may be an inlet end annular attachment 521. The directing attachment 524 may be configured to extend the passage 514 to an interior 528 of the oil separation chamber 206 past the inlet end annular attachment 521. The one or more annular attachments 522 may also include an outlet end annular attachment 523. The outlet 554 of the blow-by vapor may be located downstream from the outlet end annular attachment 523. In this way the outlet end annular attachment 523 may be in the path of the blow-by vapors and may be also disposed to be impacted by the blow-by vapors such that droplets of oil may form on portions of the oil baffle 204 and/or the cam cover 202 attached to the oil baffle 204 at the annular attachment 523.

An enclosing attachment 530 may extend from the first attachment 510 to the inlet end annular attachment 521. In this way a portion of the first attachment 510, the second attachment 512, the directing attachment 524, and the enclosing attachment 530 may form an enclosed portion 532 between the oil baffle 204 and the cam cover 202. The enclosed portion 532 may not experience the pressure changes and/or the vibration that other portions of the oil separation chamber may experience. The enclosed portion 532, in this example, may provide an attachment area within the respective attachments. The attachment area may provide a relatively low energy zone within the oil separation chamber. The enclosed portion 532 may be located at or near the leading edge, i.e. the inlet end 505 of the oil separation chamber. The leading edge may be subjected to the greatest stress from the blow-by vapors. Other locations, other configurations, or other quantities of enclosed portions may be included. The enclosed portion 532 may help to reduce vibration of the oil baffle 204, and/or may reduce the amount of transmitted vibration that may be transmitted to the cam cover 202. In this way the flow of the blow-by vapor may be directed around the oil separation chamber a sufficient amount to provide sufficient impact with surfaces within the oil separation chamber to cause sufficient separation of the oil from the blow-by vapors, and the attachment pattern may also provide the oil baffle and cam cover assembly with sufficient rigidity to reduce surface vibration and radiated noise.

The oil baffle 204 may be attached to the cam cover 202 using various attachment mechanisms. The attachment mechanisms may include, for example, vibration welding or adhesives or fasteners, and the like.

Returning again to FIG. 3, the cam cover 202 may include a number of attachment walls 600 extending from an inner surface 602 of the cam cover 202 toward the cylinder head 94. Each of the attachment walls 600 may terminate in an attachment plane. The oil baffle first face 404 may be attached to the attachment walls 600 at the attachment plane. The attachment walls 600 may be attached to the oil baffle in the attachment pattern 500 described herein. The attachment walls 600 in the attachment pattern 500, on another pattern may be configured to form the same tortuous path for the blow-by vapors from the crankcase 41 as described, or another path. The cam cover 202 may also include a number of annular rims 604 surrounding each of the spark plug holes 327. The annular rims 604 may be attached to the oil baffle 204 at the annular attachment 523 as discussed above.

In another example the cam cover 202 may include a number attachment walls 600 that may not terminate in an attachment plane, but may instead terminate at various locations. In such examples, the oil baffle 204 may have a corresponding shape, or intermediate elements may be included, for example, to provide attachment surfaces to couple the oil baffle 204 to the cam cover 202.

Figure 7:
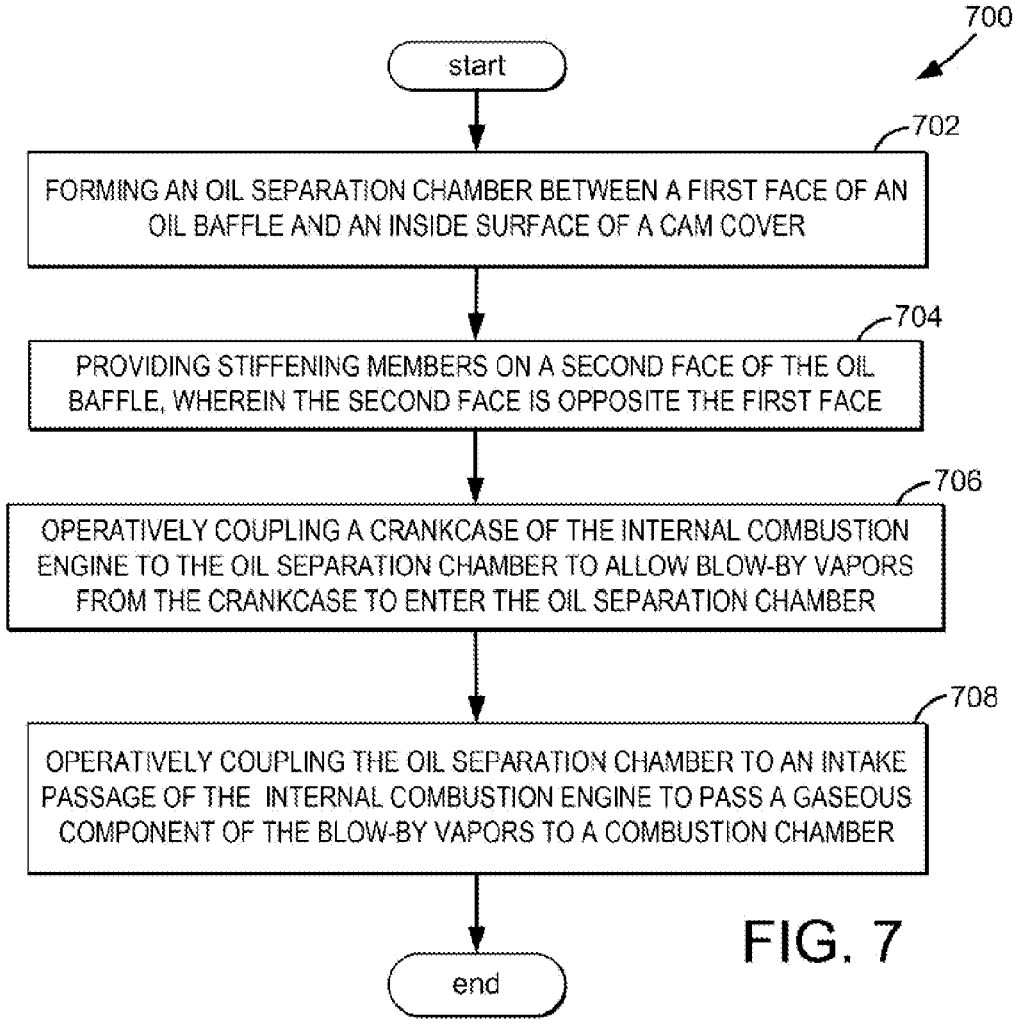
FIG. 7 is a flow diagram illustrating an example method in accordance with the disclosure.

FIG. 7 is a flow chart illustrating a method 700 of forming an oil separator for an internal combustion engine that may be implemented to separate a gaseous component from oil in a blow-by vapor. The method 700 may be implemented via the components and systems described above, but alternatively may be implemented using other suitable components. The method 700 may include, at 702, forming an oil separation chamber between a first face of an oil baffle and an inside surface of a cam cover. The method 700 may also include, at 704, providing stiffening members on a second face of the oil baffle, wherein the second face is opposite the first face. The method 700 may also include, at 706, operatively coupling a crankcase of the internal combustion engine to the oil separation chamber to allow blow-by vapors from the crankcase to enter the oil separation chamber. In addition, the method 700 may also include, at 708, operatively coupling the oil separation chamber to an intake passage of the internal combustion engine to pass a gaseous component of the blow-by vapors to a combustion chamber that may be part of the internal combustion engine.

In some examples the providing stiffening members may include forming the oil baffle with stiffening ribs extending from the second face, wherein the stiffening ribs may be integrally formed with the first face and the second face. In some examples method 700 may also include forming the oil baffle from a composite material including a plastic.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An oil baffle for use with an internal combustion engine comprising:

a generally planar body having a first side and a second side, the first side configured to be attached to a cam cover and configured to form an oil separation chamber between the first side and the cam cover;

at least two holes through the planar body and arranged substantially along a longitudinal axis of the oil baffle; and stiffening members extending from the second side including at least two substantially cylindrical elements extending from the second side and disposed around each of the at least two holes, and two spaced apart longitudinal ribs arranged on either side of and substantially parallel to the longitudinal axis.

2. The oil baffle of claim 1, wherein the oil separation chamber includes an inlet at a first end of the oil separation chamber configured to receive a blow-by vapor from a crankcase, and an outlet coupled to an intake passage of the internal combustion engine configured to pass a gas component of the blow-by vapor to the intake passage, the cam cover having a number of attachment walls extending from an inside surface of the cam cover, the attachment walls being attached to the oil baffle first side, the attachment walls forming a tortuous path for the blow-by vapors.

3. The oil baffle of claim 1, wherein the stiffening members include a perimeter wall extending from a perimeter of the planar body.

4. The oil baffle of claim 3, wherein each of the longitudinal ribs are connected on a first end to the perimeter wall and connected on a second end to one of the cylindrical elements.

5. The oil baffle of claim 3, wherein the stiffening members include two or more transverse ribs each connected to the perimeter wall at opposite ends thereof and each crossing and connected to the longitudinal ribs.

6. The oil baffle of claim 1, wherein each of the longitudinal ribs are connected on a first end to the one of the cylindrical elements, and connected on a second end to another of the one of the cylindrical elements.

7. The oil baffle of claim 1, wherein the oil baffle is made from a composite material including a plastic wherein the cylindrical elements, and the stiffening members are formed integrally with the planar body.

8. The oil baffle of claim 1, wherein one or more surfaces on the planar body first side are configured to be exposed to an oil and gas mixture and are configured to allow at least some of the oil from the oil and gas mixture to at least temporarily attach to the one or more surfaces and to separate from the oil and gas mixture, and wherein the oil and gas mixture is from a crankcase of the internal combustion engine and is introduced to the oil baffle via a Positive Crankcase Ventilation (PCV) valve.

9. An oil baffle for an engine, comprising:

a generally planar body having:

a first cam cover side forming an oil separation chamber between the first side and a cam cover;

a second side;

two holes through the planar body and arranged along a longitudinal axis;

cylindrical elements extending from the second side around each of the holes; and two spaced apart longitudinal ribs arranged on either side of and parallel to the longitudinal axis.

10. The oil baffle of claim 9, wherein the oil baffle is a composite plastic oil baffle.

* * * * *